US006325688B1

(12) United States Patent
Martin

(10) Patent No.: US 6,325,688 B1
(45) Date of Patent: Dec. 4, 2001

(54) LIFERAFT

(75) Inventor: Michael Martin, Lymm (GB)

(73) Assignee: Wardle Storeys (Safety & Survival Equipment) Limited, Barnoldswick (GB)

( * ) Notice: Subject to any disclaimer, the term of this patent is extended or adjusted under 35 U.S.C. 154(b) by 0 days.

(21) Appl. No.: 09/696,023

(22) Filed: Oct. 26, 2000

Related U.S. Application Data

(63) Continuation of application No. 09/230,518, filed as application No. PCT/GB98/01642 on Jun. 4, 1998, now abandoned.

(30) Foreign Application Priority Data

Jun. 5, 1997 (GB) ..... 9711531

(51) Int. Cl.[7] ..... B63B 35/58
(52) U.S. Cl. ..... 441/38; 114/345
(58) Field of Search ..... 441/35, 37, 38, 441/40, 44; 114/345

(56) References Cited

U.S. PATENT DOCUMENTS 3,037,218 * 6/1962 Brooks, III ..... 441/38
4,517,914 5/1985 Geracitano .
4,828,520 5/1989 Baughman et al. .
5,733,158 * 3/1998 Higginbotham et al. ..... 441/38

FOREIGN PATENT DOCUMENTS 440576 4/1970 (AU) .
2040867 1/1971 (FR) .
2147656 3/1973 (FR) .
2152105 4/1973 (FR) .
0839716 6/1960 (GB) .
1405279 9/1975 (GB) .

* cited by examiner

*Primary Examiner*—Jesus D. Sotelo
(74) *Attorney, Agent, or Firm*—Stevens Davis Miller & Mosher L.L.P.

(57) ABSTRACT

A liferaft has a floor (52) surrounded by one or more inflatable tubes (50, 51). Two canopies (54*a*, 54*b*) are provided, one (54*a*) covering one side of the floor (52) and the other (54*b*) covering the other side of the floor (52). When the liferaft is deployed on water, support means, which may be an inflatable column (63), erect the canopy (54*a*) that is above the water. The other canopy (54*b*) is unerected and lies in the water. The system of weights (67) and elastic ropes (66) forms the canopy in the water into stabilizing means in the form of water pockets. Similar means are provided on the deployed canopy (54*a*) but, when the canopy (54*a*) is erected, they lie flush with the canopy surface and so do not interfere with the operation of the liferaft.

18 Claims, 4 Drawing Sheets

LIFERAFT

CROSS-REFERENCES TO RELATED APPLICATIONS

This application is a continuation application based on U.S. Ser. No. 09/230,518, filed Jan. 27, 1999, which is a 35 U.S.C 371 application based on PCT/GB98/01642, filed Jun. 4, 1998.

This invention relates to a liferaft and in particular to a reversible liferaft i.e. one which can be occupied satisfactorily regardless of the way it floats.

It is known to provide a liferaft with means which project into the water, when the liferaft is floating on water, and stabilize the liferaft. One example is the provision of stabilizing pockets which project downwards into the water and fill with water to provide a degree of stability when the inflated liferaft is floating on water. However, these pockets do require the usage of a significant amount of fabric and when not in use can cause obstruction. When such pockets are provided on both the upper and lower sides of a reversible liferaft, those pockets which are on the upper side can whip or flutter in windy conditions.

It is the object of the present invention to provide a liferaft in which the above disadvantages are substantially overcome.

According to the invention, there is provided a reversible liferaft comprising a floor having a periphery, a first side and a second side, at least one inflatable tube surrounding and connected to the periphery of the sheet, an erectable first canopy extending over the first side of the floor and an erectable second canopy extending over the second side of the floor, support means for holding erect that one of the first and second canopies which is on the upper side of the liferaft when the liferaft is deployed and floating on water, the other of the first and second canopies then being unerected, and shaping means operative when the liferaft is deployed and floating on water for providing stabilizing means for the liferaft from said other canopy.

One embodiment of the invention, a reversible liferaft capable of carrying several people, will now be described by way of example only with reference to the accompanying drawing in which.

Figure 1:
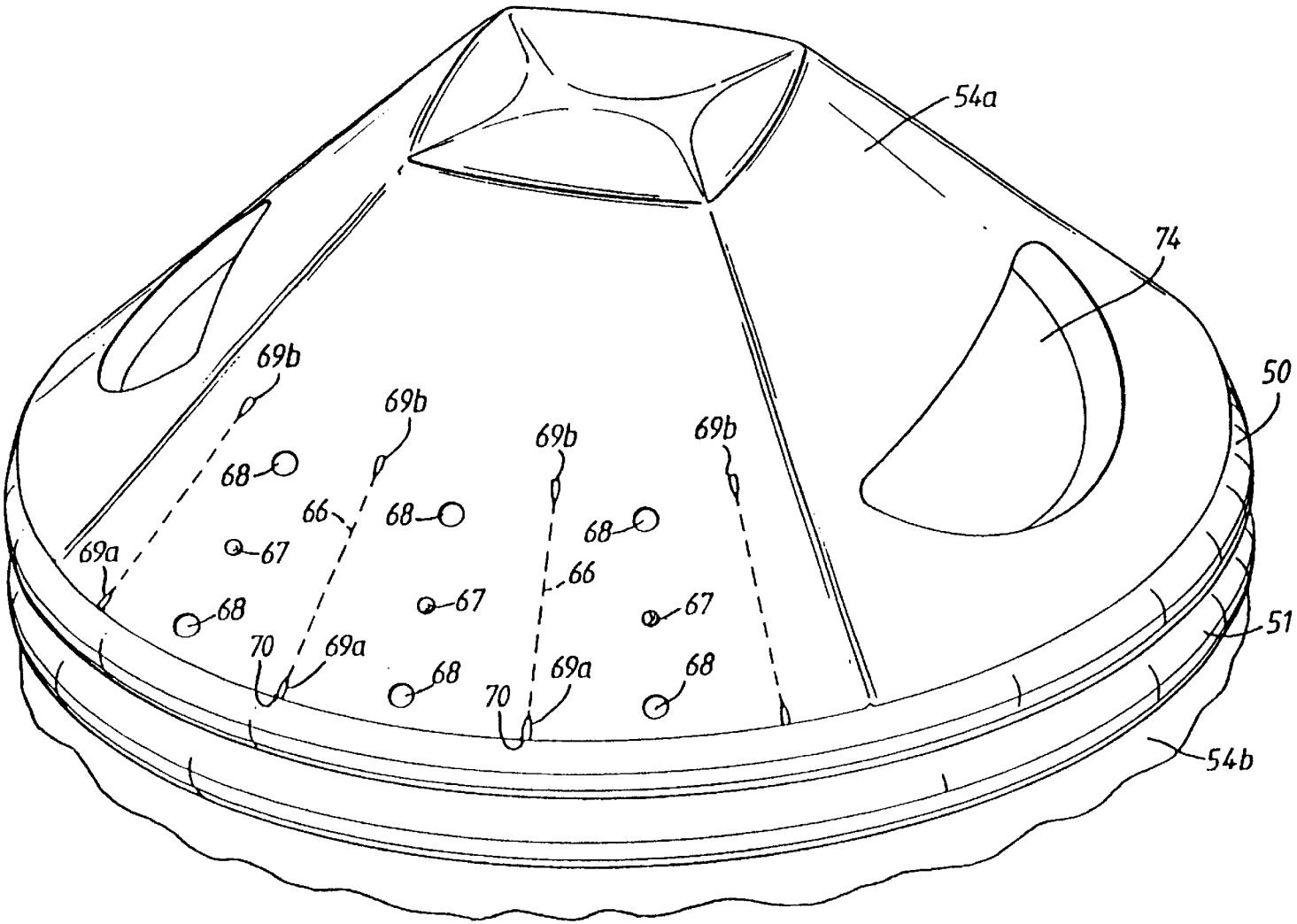
FIG. 1 shows a perspective view from above of an inflated reversible liferaft.

Referring first to FIG. 1, the liferaft comprises two buoyancy tubes 50,51 which, when inflated, are toroidal. Both tubes 50,51 are manufactured from air-holding waterproof fabric. They are positioned, when inflated, one above the other. The tubes 51,52 are joined together along a circular line 58 of contact (see FIG. 2). The buoyancy tubes 51,52 may alternatively be polygonal comprising for example eight, ten or twelve straight sections with angled corners between them. There may, of course, be more or less than two tubes 51,52.

A sheet 52 of waterproof fabric is joined e.g. by adhesive or welding, to the tubes 50,51 at the line 58 of contact to provide a floor for the liferaft.

Figure 2:
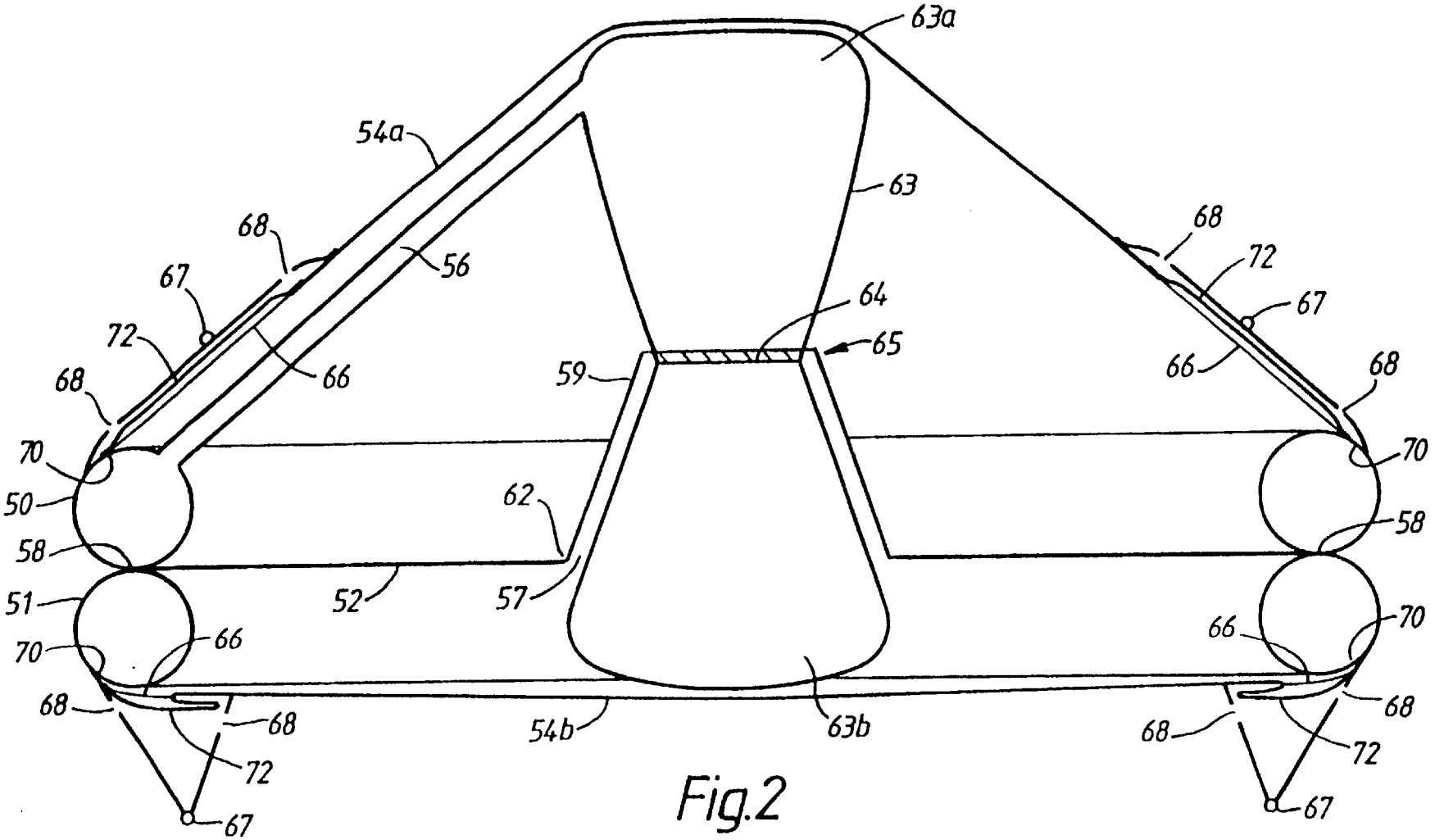
FIG. 2 shows a vertical cross-section through the liferaft shown in FIG. 1.

A circular aperture 57 is formed at the centre of the sheet 52. A part conical sleeve 59 has a wider circular end 62 attached to the periphery of the aperture 57. The other, narrower, end 64 of the sleeve 59 is attached to the centre 65 of an inflatable column 63 which, when inflated, is of circular cross-section. The column 63 is in the form of two part cones, as can be seen in FIG. 2. The narrow ends of the part cones are at the centre 65 of the column 63 and the wider ends 63*a* and 63*b* are at the top and bottom of the column 63 respectively.

Two canopies 54*a* and 54*b* are provided, each comprising a sheet of waterproof fabric. One canopy 54*a* overlies a first side of the floor 52 and the other canopy overlies a second side of the floor 52. Each canopy 54*a*, 54*b* is part conical when deployed with a wider end connected around an associated one of the tubes 51,52 along a line 70 and a narrower end closed by a panel 61. Each canopy 54*a*, 54*b* carries a plurality of weights 67 located at angularly spaced intervals around the associated canopy 54*a*, 54*b* and a plurality of elasticated ropes 66 (sometimes known as "bungee cords") The elasticated ropes 66 extend side-by-side along the length of the associated canopy 54*a*, 54*b* and are equi-angularly spaced around the associated canopy 54*a*, 54*b*. (Only some weights 67 and ropes 66 are shown in FIG. 1.)

Figure 3:
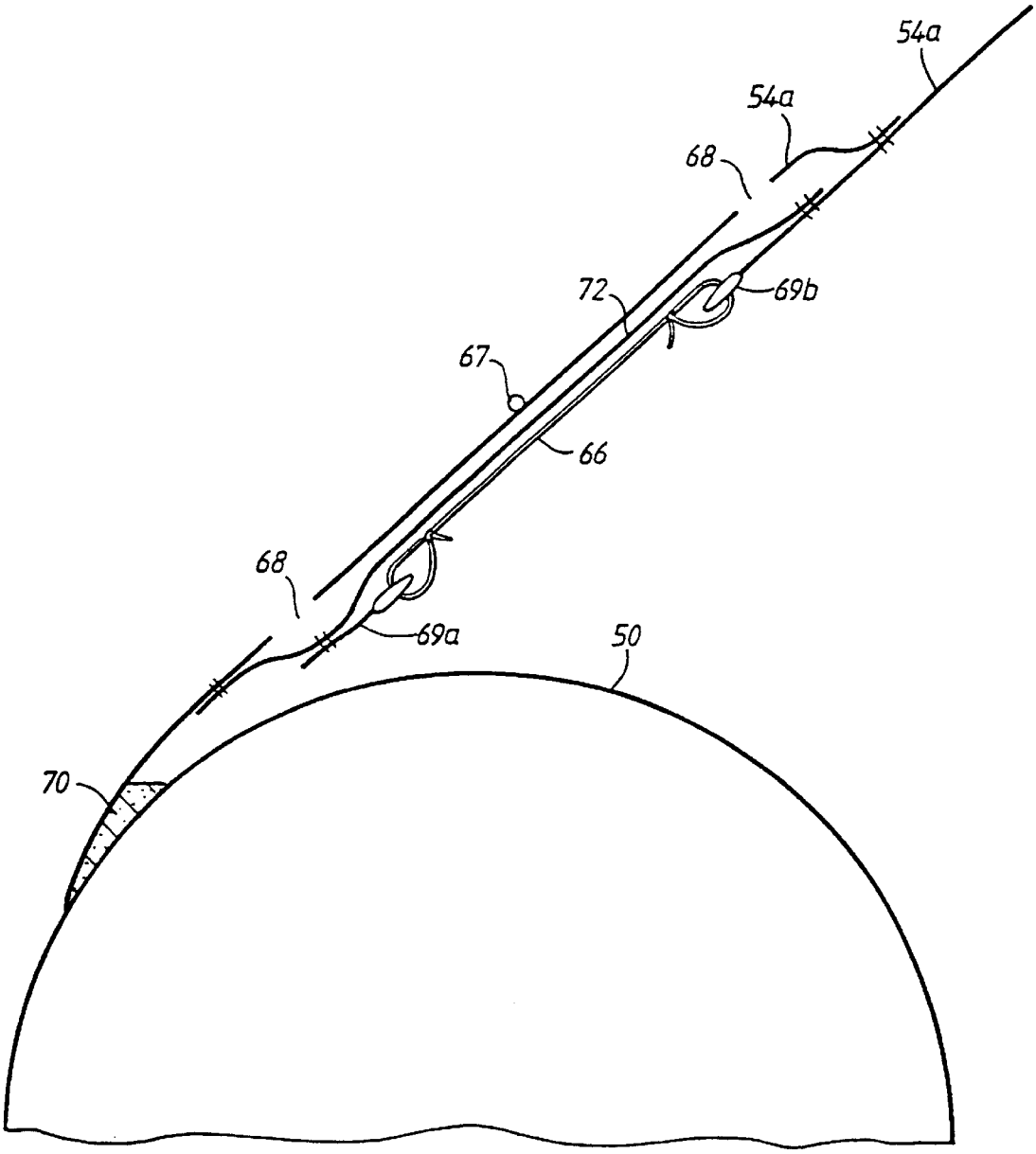
FIG. 3 shows on an enlarged scale part of the liferaft shown in FIG. 2.

As best seen in FIG. 3, each elasticated rope 66 is connected at one end to a first attachment point 69*a* adjacent the associated tube 50,51 and a second attachment point 69*b* spaced along the associated canopy 54*a*, 54*b*. The ropes 66 and the attachment points 69*a*, 69*b* are within the associated canopy 54*a*, 54*b*, as seen in FIG. 3. When the associated canopy 54*a*, 54*b* is deployed (as is the upper canopy 54*a* in the Figures) the ropes 66 are tensioned.

Each weight 67 is attached to the associated canopy 54*a*, 54*b* and is at a position approximately level with the midpoint of the length of an associated elasticated rope 66. (Although the weights 67 appear in FIGS. 2, 3 and 4 to be in the same plane as the elasticated ropes 66, they do not have to be so positioned and may be positioned as shown in FIG. 1). Several holes 68 are provided in each canopy 54*a*, 54*b*. Some holes 68 are positioned closer to the associated tube 50 or 51 than the weights 67 and others are positioned further from the associated tube 50 or 51 than the weights 67.

Two secondary skins 72 are provided of the same fabric as the canopies 54*a*, 54*b*. Each secondary skin 72 lies between a respective canopy 54*a* and 54*b* and the elasticated ropes 66.

As seen particularly in FIG. 2, when the liferaft is inflated and floating on water. The column 63 is forced upwards due to buoyancy forces and takes up the elevated position shown. The extent of this elevation is limited by the constraint applied by the sleeve 59 and the upper canopy 54*a*. Thus, one canopy 54*a* extends from the upper buoyancy tube 50 and over the top end 63*a* of the column 63 and is thus deployed for use. The other canopy 54*b* is positioned under the liferaft, extending from the lower tube 51 and under the lower end 63*b* of the column 63. This canopy 54*b* is not deployed by the column 63. As can be seen particularly in FIG. 3, the elasticated ropes 66 associated with the upper canopy 54*a* are stretched by the effect of the column on the canopy 54*a*.

Figure 4:
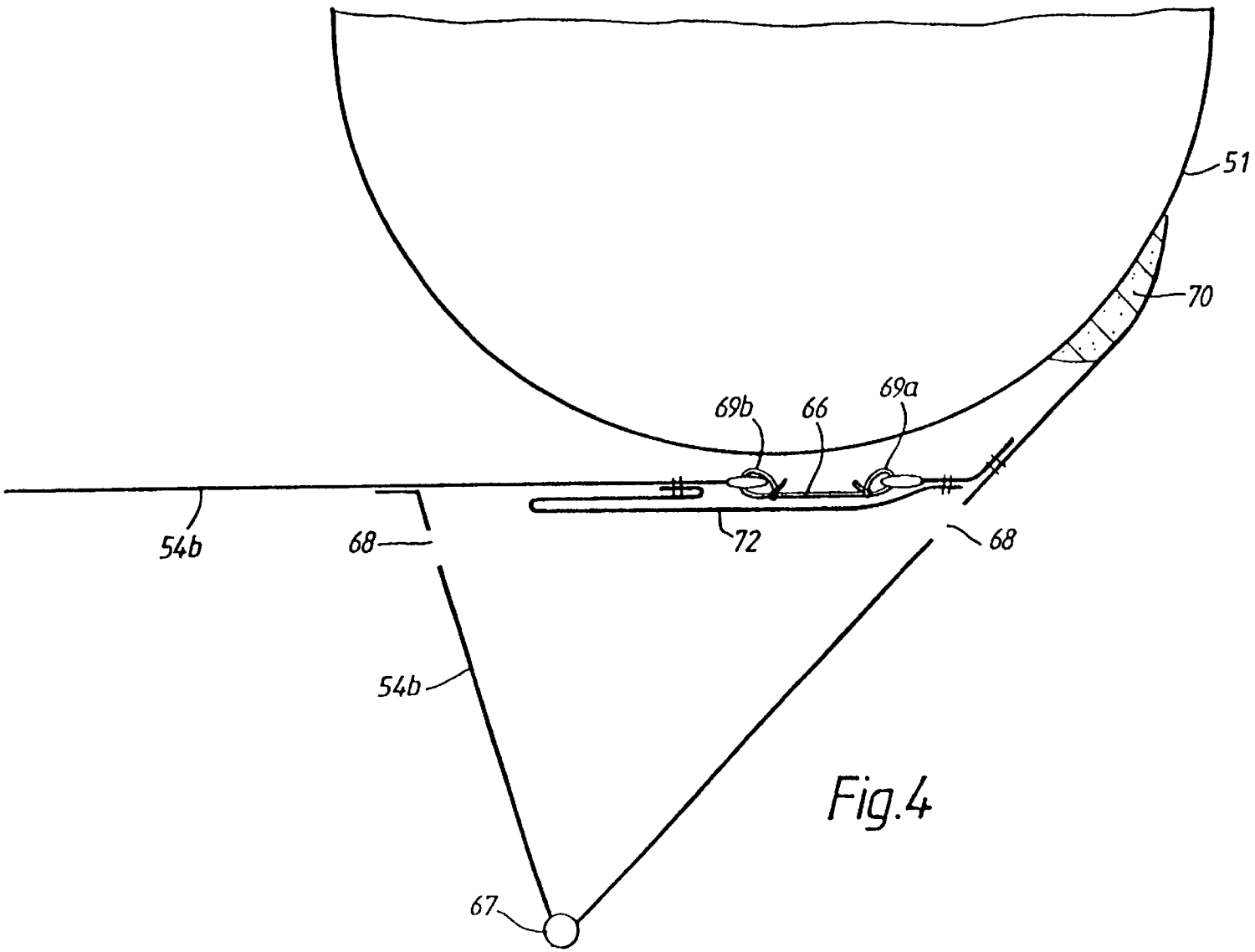
FIG. 4 shows on an enlarged scale another part of the liferaft shown in FIG. 2.

The lower end 63*b* of the column 63 does not act on the lower canopy 54*b* and so the elasticated ropes 66 associated with the lower canopy 54*b* relax i.e. shorten, and pull on the material of the canopy at the connections 69*a*, 69*b*. The part of the canopy 54*b* overlying the elasticated ropes 66 projects downwards in a fold, due to the force applied by the weights 67, and is shaped by the weights 67 and the ropes 66 to have a substantially V-shaped triangular cross-section, as seen in FIGS. 2 and 4. The holes 68 in the lower canopy 54*b* allow water to enter into and air to exit from the generally triangular cross-section annular water pocket so formed. The presence of the secondary skin 72 prevents water entering the interior of the lower canopy 54*b* and so, should the liferaft invert, the space formed by this canopy 54*b* when deployed by the column 63 will be dry. This secondary skin 72 on the underside of the liferaft forms into folds under the action of the ropes 66. A plurality of fabric bulkheads (not shown) may be provided to divide the space into a plurality of circumferentially separate pockets. The overall effect is that the liferaft is provided with stability.

The remainder of the lower canopy 54*b* is held taut against the underside of the liferaft, as seen in FIG. 2.

As shown in FIG. 2, the column 63 is connected via a flexible feed tube 56 to the upper buoyancy tube 50. The column 63 and buoyancy tube 50 are thus both automatically inflated from the same source (not shown), when the liferaft is deployed in water, a valve system (not shown) ensuring that the tubes 50 and 51 are inflated before the column 63.

Each canopy 54*a* and 54*b* is provided with entrances 74 through which an occupant can climb from the water over the buoyancy tubes 50, 51 and into the liferaft. Observation ports or windows (not shown) may also be provided.

Although in the embodiment just described the upper canopy is supported in the erected condition by means of a single column 63, other support means such as arching inflatable tubes or rigid steel tubes may alternatively be utilized.

When the liferaft is deployed (as shown in the drawings) the outer surface of the upper canopy 54*a* remains substantially smooth. The pockets which would be formed if the upper canopy were on the underside effectively retract thus preventing fluttering, or in the extreme, whipping, due to wind. Further no obstruction is caused and there are no places where unwanted water due to rain or wave action can collect. The overall construction provides for economical use of fabric.

In the embodiment described above with reference to the drawings, the water pocket extends around the whole of the undersurface of the liferaft. This need not be the case. By providing ropes 66 and weights 67 on only portions of the canopy 54*b*, a succession of angularly spaced water pockets may be provided. Of course, only one water pocket may be formed of limited circumferential extent.

Further, although the embodiment described above forms water pockets, other stabilizing means may be deployed. For example, vertical boards may be deployed or other stabilizing devices.

The weights 67 are optional. The canopy 54*b* may fold under its own weight. The elastic ropes 66 may be replaced by springs or any other extensible device that can relax and deploy a stabilizing device.

What is claimed is:

1. A reversible liferaft comprising a floor having a periphery, a first side and a second side, at least one inflatable tube surrounding and connected to the periphery of the floor, an erectable first canopy extending over the first side of the floor and an erectable second canopy extending over the second side of the floor, one of said first and second canopies being on an upper side of the liferaft when the liferaft is deployed and floating on water, support means for holding erect that one of said first and second canopies which is on the upper side of the liferaft when the liferaft is deployed and floating on water, the other of the first and second canopies then being unerected, and shaping means operative when the liferaft is deployed and floating on water for providing stabilizing means for the liferaft from part of said other canopy.

2. A reversible liferaft comprising a floor having a periphery, a first side and a second side, at least one inflatable tube surrounding and connected to the periphery of the floor, an erectable first canopy extending over the first side of the floor and an erectable second canopy extending over the second side of the floor, one of said first and second canopies being on an upper side of the liferaft when the liferaft is deployed and floating on water, support means for holding erect that one of said first and second canopies which is on the upper side of the liferaft when the liferaft is deployed and floating on water, the other of the first and second canopies then being unerected, and shaping means operative when the liferaft is deployed and floating on water for providing stabilizing means for the liferaft from part of said other canopy, wherein the shaping means form said other canopy into a stabilizing device projecting downwardly from the aside of the liferaft that is the lower side when the liferaft is deployed and floating on water.

3. A liferaft according to claim 2 wherein the stabilizing device comprises a water pocket.

4. A liferaft according to claim 3 wherein the water pocket is of triangular cross-section.

5. A liferaft according to claim 3 wherein the shaping means form the water pocket from a V-shaped fold of the canopy, the fold being provided with holes for the passage therethrough of water.

6. A liferaft according to claim 5 wherein the shaping means comprise an elastic rope, each of the first and second canopies carrying at least one elastic rope, each elastic rope being tensioned when the associated canopy is erect and forming the V-shaped fold when the associated canopy is unerected.

7. A liferaft according to claim 6 wherein plurality of elastic ropes are provided on each of the first and second canopies, the ropes associated with each canopy being arranged at spaced locations around the associated canopy, the ropes extending side-by-side.

8. liferaft according to claim 6 wherein a sheet is provided extending between upper ends of the V-shaped fold to close said upper end and so prevent water passing from the water pocket to the interior of the associated canopy.

9. A liferaft according to claim 5 wherein the shaping means comprise a weight, each of the first and second canopies carrying at least one weight, each weight forming the V-shaped fold when the associated canopy is unerected and the liferaft is deployed and floating on water.

10. A liferaft according to claim 9 wherein a plurality of weights are provided on each of the first and second canopies.

11. A liferaft according to claim 9 wherein the shaping means comprise an elastic rope, each of the first and second canopies carrying at least one elastic rope, each elastic rope being tensioned when the associated canopy is erect and forming the V-shaped fold when the associated canopy is unerected, wherein each weight is associated with a respective rope.

12. A liferaft according to claim 3, wherein the water pocket is annular extending around the whole lower side of the liferaft.

13. A liferaft according to claim 3, wherein the water pocket is sub-divided into sections.

14. reversible liferaft comprising a floor having a periphery, a first side and a second side, at least one inflatable tube surrounding and connected to the periphery of the floor, an erectable first canopy extending over the first side of the floor and an erectable second canopy extending over the second side of the floor, one of said first and second canopies being on an upper side of the liferaft when the liferaft is deployed and floating on water, support means for holding erect that one of said first and second canopies which is on the upper side of the liferaft when the liferaft is deployed and floating on water, the other of the first and second canopies then being unerected, and shaping means connected to said canopy and operative when the liferaft is deployed and floating on water to act on said canopy to shape part of said other canopy into stabilizing means.

15. The reversible liferaft of claim 14, wherein the shaping means form said other canopy into a stabilizing device projecting downwardly from the aside of the liferaft that is the lower side when the liferaft is deployed and floating on water.

16. The reversible liferaft of claim 15 wherein the stabilizing device comprises a water pocket.

17. The reversible liferaft of claim 16, wherein the shaping means form the water pocket from a V-shaped fold of the canopy, the fold being provided with holes for the passage of water therethrough.

18. The liferaft according to claim 17, wherein the shaping means compose a weight, each of the first and second canopies carrying at least one weight, each weight forming the V-shaped fold when the associated canopy is unerected and the liferaft is deployed and floating on water.

* * * * *